United States Patent [19]

Edison

[11] 3,975,041

[45] Aug. 17, 1976

[54] SLIDING PANEL LOCK

[76] Inventor: Timothy Edison, 2590 Highland, San Diego, Calif. 92105

[22] Filed: Apr. 18, 1975

[21] Appl. No.: 569,590

[52] U.S. Cl. ..... 292/258; 292/288; 292/DIG. 46

[51] Int. Cl.[2] ..... E05C 19/18

[58] Field of Search ..... 292/343, 342, DIG. 46, 292/288, 258

[56] References Cited

UNITED STATES PATENTS

| | | | |
|---|---|---|---|
| 1,178,356 | 4/1916 | Stevens | 292/288 |
| 1,463,222 | 7/1923 | Mologne | 292/343 |
| 2,528,618 | 11/1950 | Sossi | 292/343 |
| 3,527,489 | 9/1970 | Nemeth | 292/288 |
| 3,756,641 | 9/1973 | Dugan | 292/258 |

*Primary Examiner*—Ramon S. Britts
*Assistant Examiner*—Darrell Marquette

[57] ABSTRACT

A sliding panel lock for locking sliding panels such as windows or patio doors slidably coupled to a frame in which the top edge of the frame is captured within an inverted U-shaped channel consisting of a wedge member having a top edge dimensioned for abutting the top inside surface of the channel and a clamp member for clamping the wedge member in position, the wedge member having an inclined bottom surface for wedging against the corner of the sliding panel and extending between the top surface of the sliding panel frame and the bottom surface of the channel into which the frame of the panel member is received, thereby preventing the sliding of the panel toward the wedge member and the lifting of the panel out of the bottom channel.

3 Claims, 3 Drawing Figures

SLIDING PANEL LOCK

BRIEF DESCRIPTION OF THE INVENTION

The present invention relates to a sliding panel lock and more particularly to a sliding panel lock which is removably attached to existing sliding panel installations.

According to the invention, a sliding panel lock is provided for the prevention of the sliding or removal of a sliding panel such as windows and patio doors. The panel lock is designed for utilization with the type of sliding panel which has its upper frame captured within a channel guide with a substantial difference between the top edge of the panel frame and the top inside surface of the channel guide for a lifting of the panel and removal thereof. A wedge member is provided which is dimensioned for having its top surface resting against the top inner surface of the channel guide and having a bottom surface which is inclined for wedging against a top corner of the panel frame. A clamp member is attached via a set screw to the channel guide and sandwiches the front edge of the channel to the wedge member and sandwiches the inside edge of the channel guide between the wedge member and the clamp member, hence holding the wedge member in place against a corner of the sliding panel frame.

An object of the present invention is the provision of an improved sliding panel lock.

Another object of the invention is the provision of a sliding panel lock which is substantially universal in application.

A further object of the invention is the provision of a sliding panel lock which is simple to install and remove.

Yet another object of the invention is the provision of a sliding panel lock which is inexpensive to manufacture and extremely convenient and effective in use.

Yet another object of the invention is the provision of a sliding panel lock for prevention of the removal and opening of a sliding panel.

Other objects and many of the attendant advantages of the present invention will be readily appreciated as the same becomes better understood by reference to the following detailed description when considered in connection with the accompanying drawings in which like reference numerals designate like parts throughout the Figures thereof and wherein.

DETAILED DESCRIPTION OF THE DRAWING

Figure 1:
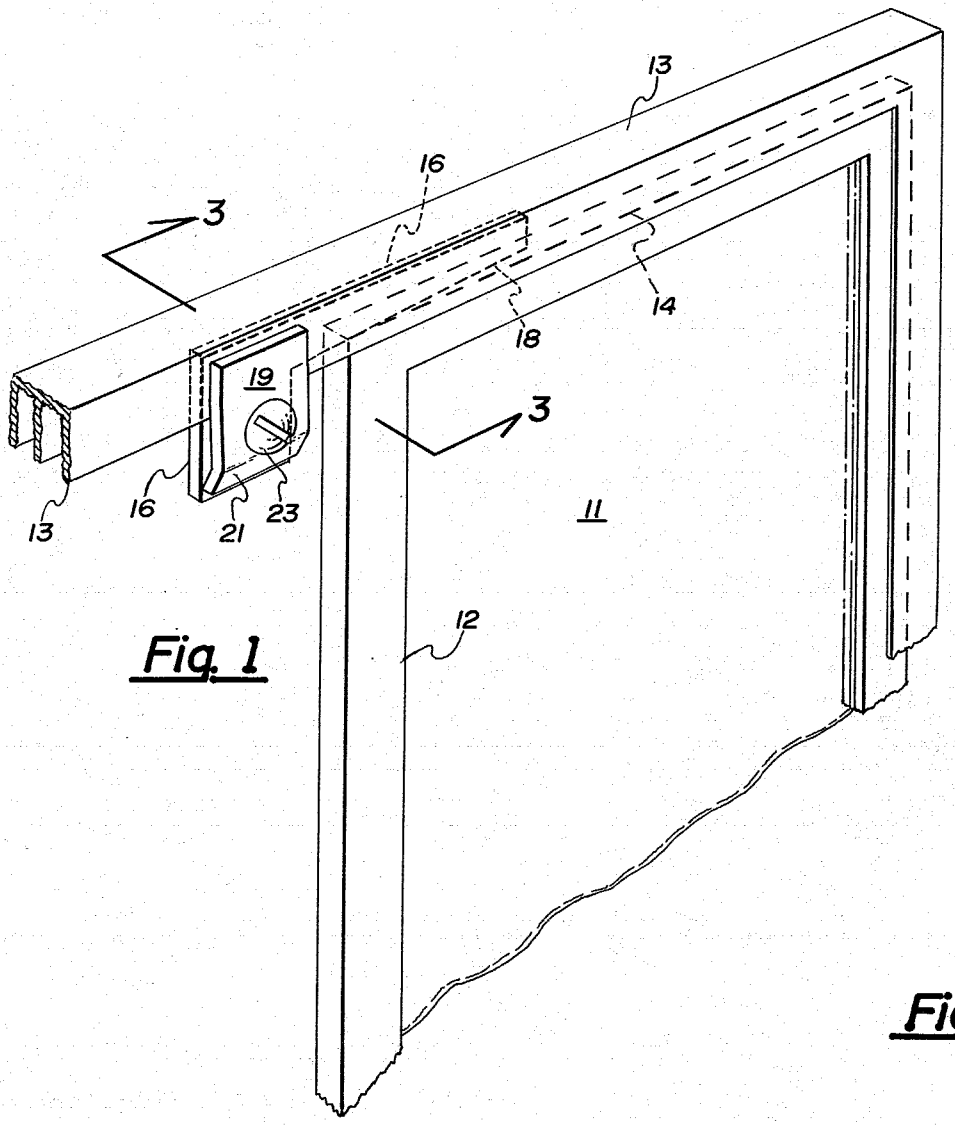
FIG. 1 is a perspective view of the preferred embodiment of the present invention in situ.

Referring to FIG. 1, a sliding panel is shown at 11 which can be a window or patio door, for example, having a frame 12. Channel guide 13 slidably receives the upper edge 14 of frame 12. Wedge member 16 having a top surface disposed against an inner top surface of channel guide 13 and inclined bottom surface which is in wedged contact with an end of top edge 14 of frame 12. Clamp member 19 clamps wedge member 16 at 21 with set screw 23 in threadable engagement (not shown) with wedge member 16, and sandwiching the front side of channel guide 13 between wedge member 16 and channel member 19.

Figure 2:
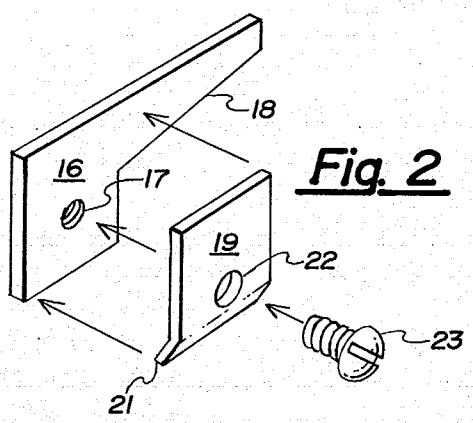
FIG. 2 is an exploded perspective view of the embodiment of FIG. 1.

Referring to FIG. 2, wedge member 16 is shown having a threaded bore 17 and an inclined lower surface 18. The clamp member 19 has an enlarged bore 22 dimensioned for receiving set screw 23 and terminating at 21 in an inwardly curved portion.

Figure 3:
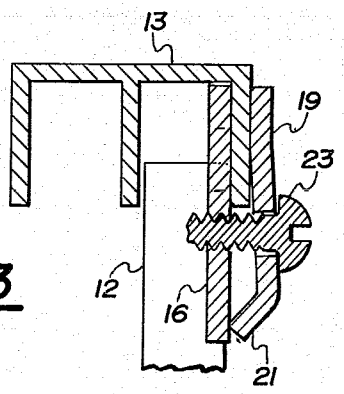
FIG. 3 is a cross sectional view taken along lines 3—3 of FIG. 1.

Referring to FIG. 3, panel frame 12 is shown slidably received within channel guide 13 with its top surface 14 spatially disposed from the bottom surface of the top of channel guide 13. Wedge member 17 is shown abutting an inner wall of channel guide 13 and in threadable engagement with set screw 23 via threaded bore 17. Set screw 23 holds clamp member 19 against channel guide 13 and a lower curved portion 21 against wedge member 17, clamping the entire assembly in place.

INSTALLATION

Referring now to all of the Figures, it can be seen that after sliding panel 11 is against one end of channel guide 13, such as shown in FIG. 1, if wedge member 16 is loosely coupled to clamp member 19 via threaded bore 17 and set screw 23, it can be inserted in the position shown in FIG. 1. At this time, set screw 23 is tightened, clamping wedge member 16 to channel guide 13 with inclined surface 18 wedged against the top 14 of frame 12 of sliding panel 11. In this position, sliding panel 11 cannot be moved to the left; hence it is locked in place solidly against one end of channel guide 13. It is also noted that sliding panel 11 cannot be lifted to remove it entirely from the channel guide for complete removal. By reversing wedge member 16 from the positions shown in FIGS. 1, 2 and 3, an opposite locking action is effected, i.e., with sliding panel 11 to a stop toward the left of FIG. 1, and wedge member 16 wedged against the top edge 14 of frame 12 and the right top corner instead of the left top corner as illustrated.

It should be understood, of course, that the foregoing disclosure relates to only a preferred embodiment of the invention, and that it is intended to cover all changes and modifications of the example of the invention herein chosen, for the purposes of the disclosure, which do not constitute departures from the spirit and scope of the invention.

The invention claimed is:

1. A sliding panel lock for limiting the sliding and preventing the removal of a sliding panel of the type that that has a frame, the top portion of which is slidably received by a guide channel having inner and outer sidewalls and a top surface integral therewith comprising:

a wedge member having an inclined lower edge;

a clamp member; and coupling means coupling said clamp member to said wedge member, said wedge member and said clamp member sandwiching one of said channel sides and being clamped thereto, said inclined edge being dimensioned for cooperating with a top corner of said sliding panel and extending over a portion of the top edge of said sliding panel.

2. The sliding panel lock of claim 1 wherein:

said clamp member is J-shaped.

3. The sliding panel lock of claim 1 wherein:

said coupling means is a threaded screw and said clamp member includes a bore dimensioned for receiving said threaded screw and said wedge member includes a threaded bore for cooperation with said threaded screw.

* * * * *